US011319184B2

(12) United States Patent
Shi

(10) Patent No.: US 11,319,184 B2
(45) Date of Patent: May 3, 2022

(54) LOCKING STRUCTURE, LOCKING DEVICE AND HOSE COILED EQUIPMENT

(71) Applicant: Yongkang Naiboen Industry & Trade Co., Ltd., YongKang (CN)

(72) Inventor: Zheng Shi, YongKang (CN)

( * ) Notice: Subject to any disclaimer, the term of this patent is extended or adjusted under 35 U.S.C. 154(b) by 250 days.

(21) Appl. No.: 16/563,887

(22) Filed: Sep. 8, 2019

(65) Prior Publication Data

US 2021/0070584 A1 Mar. 11, 2021

(51) Int. Cl.
*B65H 75/44* (2006.01)

(52) U.S. Cl.
CPC ..... *B65H 75/4402* (2013.01); *B65H 75/4471* (2013.01); *B65H 2601/26* (2013.01); *B65H 2701/11214* (2013.01)

(58) Field of Classification Search
CPC ..... B65H 75/4402; B65H 75/4471; B65H 75/4434; B65H 75/446; B65H 2701/11214; B65H 75/44
See application file for complete search history.

(56) References Cited

U.S. PATENT DOCUMENTS 3,627,222 A * 12/1971 Quenot ..... H01F 7/0242 242/394.1
6,786,428 B1 * 9/2004 Huang ..... B65H 75/40 137/355.16
7,766,272 B2 * 8/2010 Ni ..... B65H 75/42 242/395.1
8,882,016 B1 * 11/2014 Melvin ..... B65H 75/4471 242/405
2002/0171002 A1 * 11/2002 Kretsch ..... B65H 75/446 242/395.1
2009/0151484 A1 * 6/2009 Mullen ..... B65H 75/4471 74/47

* cited by examiner

*Primary Examiner* — Sang K Kim

(57) ABSTRACT

The invention discloses a locking structure for adjusting and/or locking a relative position between the first structure and the second structure, comprising: locking body, being movably connected to the first structure; a first member, extending along the length of the locking body and connected to the locking body; a guiding body disposed on the first member. The guiding body adjusts a relative position between the first structure and the second structure by moving along the guiding passage. The guiding body locks a relative position between the first structure and the second structure by entering a locking area of the guiding passage. The present invention further discloses a locking device and a coiling device using the locking structure. By providing a first member having a guiding body on the first structure and simultaneously providing a guiding passage on the second structure, when the first structure and the second structure are moved relatively, the guiding body is guided on the guiding passage. Different positions are used to adjust the relative position between the first structure and the second structure, and the locking of the specific position is completed, the locking effect is good and the reliability is high.

16 Claims, 16 Drawing Sheets

LOCKING STRUCTURE, LOCKING DEVICE AND HOSE COILED EQUIPMENT

TECHNICAL FIELD

The present invention relates to the field of pipe wrapping equipment, and more particularly to a locking structure and a hose coiled equipment of the locking structure.

BACKGROUND

The reel equipment is also called the winder equipment. The tube or wire is wound on a shaft. It can be automatically retracted after being pulled out. It is simple and practical. It is used in various production assembly workshops, maintenance workshops, automobile beauty shops, automobile 4S shops and other workplaces, widely used. In particular, gardening and the like for irrigating gardens in home applications require hoses for irrigation. To ensure the ease of use of the hoses, the coiling of the hoses can also improve the cleanliness of the hoses.

The structure of the reel equipment mainly includes a casing, a reel equipment is arranged in the casing, a hose is wound around the reel, and a coil spring is connected in the reel. When the hose is pulled out, the hose will drive the reel to rotate, and the reel drives the coil spring to tighten the pressure accumulation. When the hose is loosened, the coil spring will drive the reel to rotate back under the action of the restoring force, and the reel will drive the hose back into the outer casing. When the hose is pulled out, in order to prevent the hose from automatically retracting. A self-locking mechanism is usually provided in the reel. The current existing self-locking mechanism mainly comprises a baffle fixed to the inner cavity wall, and the baffle is provided with a spring on one side of the baffle and a handle with a handle, and the spring which resets the dial a cover plate is fixed to the left half of the baffle, and a gear movable slot is formed between the cover plate and the baffle plate. The slot is provided with a pinion gear that can mesh with the teeth on the dial block, and the pinion gear can rotate and can be rotated in the gear movable slot. Translation activity. At the same time, it can be meshed with the movable tooth block with only partial teeth, and the movable tooth block is fixed with the main wheel plate. The structure has the disadvantages of complicated structure, troublesome manufacture and installation, and difficulty in controlling the hose locking operation during use. When the hose is retracted, there will be a lock, and when the lock is suddenly locked, the two gears collide, which is liable to cause a broken tooth and poor reliability.

SUMMARY

The present invention is directed to the problem of insufficient reliability of the locking mechanism in the prior art, and provides a locking structure for adjusting and/or locking the relative position between the first structure and the second structure, and specifically includes: locking body, being movably connected to the first structure; a first member, extending along the length of the locking body and connected to the locking body; a guiding body, disposed on the first member; the guiding body adjusts a relative position between the first structure and the second structure by moving along the guiding passage. The guiding body locks a relative position between the first structure and the second structure by entering a locking area of the guiding passage.

Further technical solutions, wherein the locking body is provided with a mounting passage, for mounting a rotating shaft disposed on the first structure. The locking body is relatively rotatable to the axis of rotation for rotational connection with the first structure.

Further technical solutions, wherein the first structure is provided with a mounting passage, for mounting a rotating shaft disposed on the locking body, the locking body passing the rotating shaft rotation to achieve a rotational connection with the first structure.

Further technical solutions, wherein one end of the guiding body is connected to the first member, and the other end is provided as a free end, for guiding along the guiding channel during movement.

Further technical solutions, wherein the guiding body is provided with a protruding structure formed from an end surface perpendicular to the first member, and a protruding structure formed from an end surface of the first member.

Further technical solutions, wherein the guiding body and the first member are also connected by the first connecting member. The first connecting member extends from the end surface of the first member to the outer end surface of the guiding body, and is limited by the outer end surface of the guiding body. The width of the first connecting member is gradually increased.

Further technical solutions, wherein the locking structure further includes a second member, the second member is formed to extend along the longitudinal direction of the locking body, and is connected to the locking body; and the adjusting space is provided between the second member and the first member, position adjustment for the first member and/or the second member.

Further technical solutions, wherein the first member and/or the second member are disposed non-parallel with respect to the locking body, and the first member and the second member are respectively disposed obliquely to both sides of the rotating surface of the locking body.

Further technical solutions, wherein the second member includes a connecting portion and an adjusting portion, the connecting portion is formed to extend from the locking body, one end of the adjusting portion is connected to the connecting portion, and the adjusting portion is disposed at an angle to the connecting portion in a direction away from the first member.

Further technical solutions, wherein the first member and/or the second member have an adjustment property, and when the force acts on the guiding body and/or the first member and/or the second member, the position of the adjustment space between the first member and the second member may be changed.

Further technical solutions, wherein the free end of the first member is provided with a limiting structure, and when the first structure and the second structure are relatively locked, the locking structure is abutted against the limiting component disposed on the second structure by the limiting structure and formed a limiting condition.

A locking device, comprising:

a guiding channel, disposed on the second structure, including a first guide channel and a second guide channel and a conversion channel;

The locking structure, wherein the locking structure adjusts and/or locks the first structure and the second structure, by the movement on the first guide channel and the second guide channel and the switching channel.

Further technical solutions, wherein the locking device further comprises a mounting structure, the mounting structure being coupled to the first structure, and having a mounting cavity for receiving the locking structure.

Further technical solutions, wherein the rotating shaft is disposed on the mounting structure, and has a convex structure extending from a bottom of the mounting cavity in a vertical direction.

Further technical solutions, wherein the mounting channel is disposed on the mounting structure, and disposed within the mounting cavity.

Further technical solutions, wherein the mounting cavity comprises a first cavity, a second cavity and a third cavity. When the locking structure is rotated relative to the mounting structure by the rotating shaft, the locking structure is moved from the first cavity to the second cavity, and/or moved by the first cavity into the third cavity. Switching of the guiding path and/or locking of the relative position between the first structure and the second structure is effected, when the locking structure is moved along the first guide channel and/or the second guide channel and/or the switching channel.

Further technical solutions, wherein the mounting cavity is provided with a first limiting area and a second limiting area, for limiting the radial direction when the locking structure is rotated, and the first limiting area is located at an end of the first cavity, the second limiting region is located at an end of the second cavity;

The locking structure is moved from the first cavity to the second cavity when the locking structure is switched from the first guide channel to the second guide channel, and/or the locking structure is switched from the moving state to the locked state in the body, and the radial direction of the first member and/or the second member is radially limited by the first limiting region;

The locking structure is moved from the first cavity to the third cavity, when the locking structure is switched from the second guide channel to the first guiding channel, and/or the locking structure is switched from the moving state to the locked state in the body, and the radial direction of the first member and/or the second member is radially limited by the second limiting region.

A hose coiled equipment, comprising: a housing, a reel assembly within the housing, and a tubing assembly disposed on the reel assembly, the tubing assembly is opened and/or locked by a locking device according to the above technical solutions.

Further technical solutions, wherein the reel assembly comprises a first reel and a second reel. The first reel is connected to the second reel to form a reel shaft for pipe assembly installation. The tubing assembly is sleeved on the reel shaft, and rotates synchronously with the reel shaft.

Further technical solutions, wherein the housing is configured as the first structure, the second reel is configured as the second structure, and the guiding channel is disposed on an outer end surface of the second reel. The locking device effects rotation and/or locking of the tubing assembly with the reel assembly, by adjusting and/or locking the relative position between the reel assembly and the housing.

The present invention achieves the following beneficial effects:

The locking structure disclosed in the present invention, is provided in the first structure and the second structure by providing a first member having a guiding body on the first structure, while providing a guiding passage on the second structure for the guiding body to move thereon. When the structure is relatively moved, that is, when the guiding body on the first member moves in the guiding passage, the relative position between the first structure and the second structure, is adjusted by different positions of the guiding body on the guiding passage, and the first position is completed. The partial relative position between the structure and the second structure is locked.

The roll-rolling device disclosed by the present invention precisely guides the guiding body on the lock member by providing a guide channel having a plurality of passages in the reel assembly, and then controls the reel to be locked or forwardly rotated by the guiding body or The reverse rotation ensures that the hoses on the reel operate smoothly, and the operation is very simple and convenient for the operator whether it is a locking tube or a tube or a tube, and the reliability is good.

The additional aspects and advantages of the invention will be set forth in part in the description which follows.

BRIEF DESCRIPTION OF THE DRAWINGS

The drawings described herein are intended to provide a further understanding of the invention, and are intended to be a part of the invention. In the drawing.

DETAILED DESCRIPTION OF THE PREFERRED EMBODIMENTS

Figure 1:
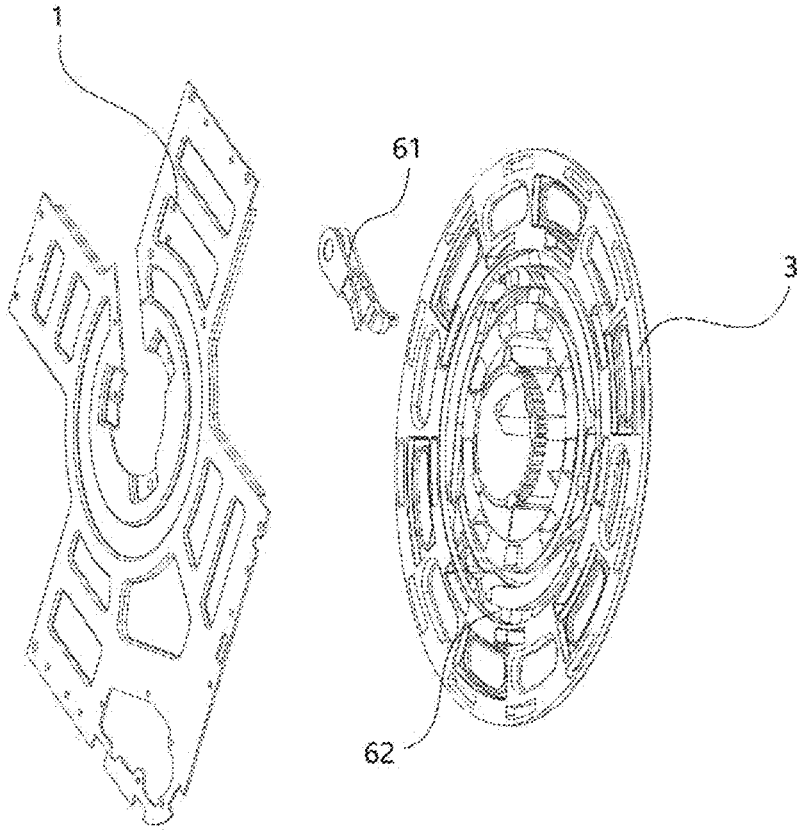
FIG. 1 is a schematic view showing the operation of a locking structure according to an embodiment of the present invention.

The technical solutions of the embodiments of the present invention will be clearly and completely, described in the following with reference to the accompanying drawings. It is apparent that the described embodiments are part of the embodiments of the invention, and not all of the embodiments. All other embodiments obtained by a person of ordinary skill in the art, based on the described embodiments of the present invention, without departing from the scope of the invention are within the scope of the invention.

In the description of the present invention, it is to be understood that the terms "center", "longitudinal", "transverse", "length", "width", "thickness", "upper", "lower", "front", orientation or position of indications such as "back", "left", "right", "vertical", "horizontal", "top", "bottom", "inside", "outside", "clockwise", "counterclockwise", etc. The relationship is based on the orientation or positional relationship shown in the drawings, and is merely for the convenience of the description of the invention and the simplification of the description, and does not indicate or imply that the device or component referred to has a specific orientation, is constructed and operated in a specific orientation, and thus it is not to be understood as limiting the invention.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present invention, the meaning of "a plurality" is two or more unless specifically and specifically defined otherwise.

In the present invention, the terms "installation", "connected", "connected", "fixed" and the like shall be understood broadly, and may be either a fixed connection or a detachable connection, unless explicitly stated and defined otherwise, or connected integrally; may be mechanical connection or electrical connection; may be directly connected, or may be indirectly connected through an intermediate medium, and may be internal communication between the two elements. For those skilled in the art, the specific meanings of the above terms in the present invention can be understood on a case-by-case basis.

In the present invention, the first feature "on" or "under" the second feature may include direct contact of the first and second features, and may also include first and second features, unless otherwise specifically defined and defined. It is not in direct contact but through additional features between them. Moreover, the first feature "above", "above" and "above" the second feature includes the first feature directly above and above the second feature, or merely indicating that the first feature level is higher than the second feature. The first feature "below", "below" and "below" the second feature includes the first feature directly below and below the second feature, or merely the first feature level being less than the second feature.

Unless otherwise defined, technical terms or scientific terms used herein shall be taken to mean the ordinary meaning of the ordinary skill in the art to which the invention pertains. The words "first", "second" and similar terms used in the specification and claims of the present invention do not denote any order, quantity, or importance, but are merely used to distinguish different components. Similarly, the words "a" or "an" and the like do not denote a quantity limitation, but mean that there is at least one.

Figure 2:
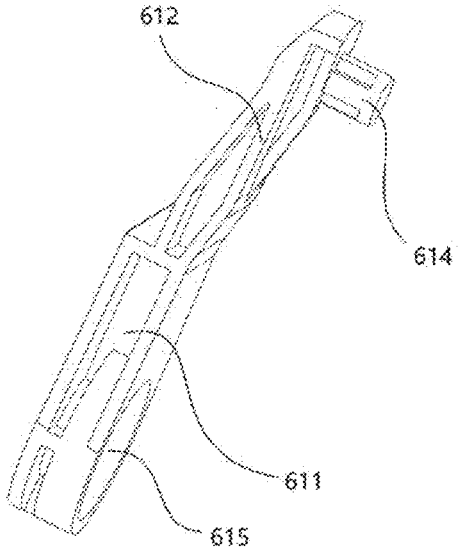
FIG. 2 is a schematic structural view of a locking structure according to an embodiment of the present invention.

As shown in FIG. 1, it is a locking structure disclosed in an embodiment of the present invention, and the locking structure is used for adjusting and/or locking the relative position between the first structure 1 and the second structure 3. As shown in FIG. 2, the locking structure includes a locking body 611, a first member 612, and a guiding body 614, wherein the locking body 611 is movably coupled to the first structure 1. The first member 612 is formed to extend along the longitudinal direction of the locking body 611 and is connected to the locking body 611. Wherein the guiding body 614 is disposed on the first member 612, and the guiding body 614 adjusts the relative position between the first structure 1 and the second structure 3, by moving along the guiding passage 62, and the guiding body 614 passes through the guiding passage 62. The locking region is used to achieve locking of the relative position between the first structure 1 and the second structure 3. The locking structure of the present embodiment is provided in the first structure and the second structure, by providing a first member having a guiding body on the first structure while providing a guiding passage on the second member for the guiding body to move thereon. When the structure is relatively moved, that is, when the guiding body on the first member moves in the guiding passage, the relative position between the first structure and the second structure is adjusted by different positions of the guiding body on the guiding passage, and the first position is completed. The partial relative position between the structure and the second structure is locked.

In some embodiments, the locking body 611 can be provided with a mounting channel 615 for mounting the rotating shaft disposed on the first structure 1. The locking body 611 can be rotated relative to the rotating shaft to implement the locking body. A rotational connection with the first structure. In other specific embodiments, the mounting channel may also be disposed on the first structure, and the rotating shaft is disposed on the locking body.

Specifically, one end of the guiding body 614 is connected to the first member 612, and the other end is provided as a free end for guiding along the guiding passage 62. Wherein, the guiding body 614 may be a protrusion structure which is perpendicular to the end surface of the first member 612, and extends from the end surface of the first member. The vertical direction of the first member ensures that the guiding body is sufficiently stable, and the conduction of the guiding channel is more convenient.

Figure 3:
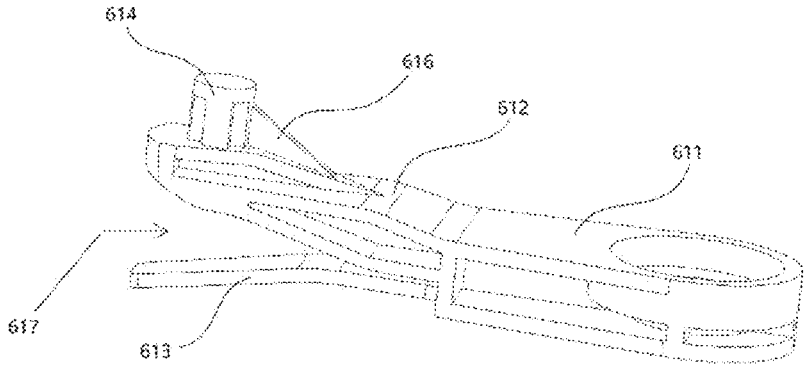
FIGS. 3 and 4 are schematic structural views of a locking structure according to another embodiment of the present invention.

As shown in FIG. 3, a schematic structural view of another locking structure disclosed in the embodiment, the guiding body 614 of the locking structure is connected to the first member 612 by a first connecting member 616. The first connecting member 616 extends from the end surface of the first member 612 to the outer end surface of the guiding body 614, and is restrained by the outer end surface of the guiding body 614, and the width of the first connecting member is also gradually increased. Specifically, the first connecting member may extend obliquely from the side of the guiding body toward the first component surface in the direction of the locking body, and the first connecting member may be used to enhance the strength of the guiding body, and prevent relative movement of the guiding body in the guiding passage. During the process, the groove of the guided channel hits and breaks. At the same time, the upper surface of the first connecting member is arranged in an inclined shape, to make the guiding body move in the forward or reverse direction in the guiding channel. When the guiding body needs to switch the position of the guiding channel, the first connecting member precedes the side of the guiding body. The guiding channel groove body contacts, thereby reducing the collision force with the groove body through the inclined surface thereof, guiding the collision region to the upper end portion of the guiding body, avoiding the broken root portion of the guiding body from being broken by the impact, and improving the reliability of the locking structure.

As shown in FIG. 3, the locking structure of this embodiment further has a second member 613 extending along the length of the locking body 611, and connected to the locking body 611. The second member 613 has an adjustment between the first member 612 and the first member 612. Adjustment space 617 is used for position adjustment of first member 612 and/or second member 613. Specifically, the second member is disposed under the first member, and the second member portion region is in contact with the first structure. When the first member is subjected to the axial pressure of the locking body when the guiding passage is moved, the adjusting space of the second member and the first member can be reduced, thereby reducing the vertical spacing between the first member and the first structure, thereby ensuring the guiding body on the first member can stably adhere to the bottom of the guiding passage, and can smoothly move relative to each other in the respective regions of the guiding passage.

In this embodiment, the first member 612 and the second member 613 are disposed in a non-parallel manner with respect to the lock body 611, wherein the first member 612 and the second member 613 are respectively disposed obliquely to both sides of the rotating surface of the lock body 611. Specifically, the first member is inclined toward the rotation axis of the lock body with respect to the rotation plane of the lock body, and is inclined away from the first structure. The second member portion structure is disposed obliquely in the direction of the first structure in the axial direction of the locking body. The partial regions of the first member and the second member are inclined in opposite directions to expand the adjustment space region, which is more advantageous for the adaptation and fitting of the guide member of the first member to the bottom of the guide channel, thereby ensuring smooth movement of the guiding body. Sex and reliability.

Figure 4:
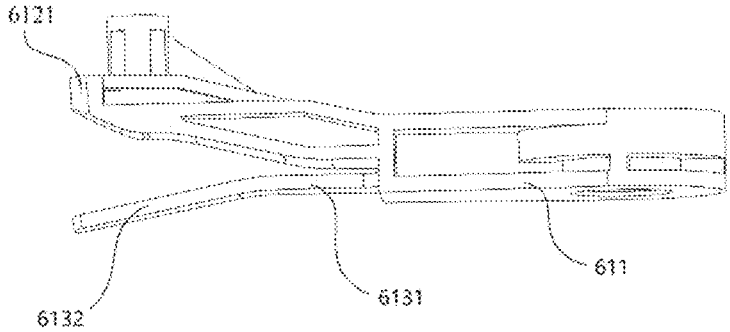

As shown in FIG. 4, in some embodiments, the second member 613 of the locking structure further includes a connecting portion 6131 and an adjusting portion 6132, wherein the connecting portion 6131 extends from the locking body 611, and one end of the adjusting portion 6132 and the connecting portion 6131 is connected, and the adjusting portion 6132 is disposed at an angle to the connecting portion 6131 in a direction away from the first member. That is, the second member may be composed of two parts which are different from the rotation direction of the locking body toward the first member. The two parts are different in inclination from the rotation plane of the locking body, and the adjusting portion at the front end of the second member, is inclined at an angle larger than the connecting portion connected to the locking body. The bending structure design can increase the degree of deformation of the second member, that is, by changing the bending angle of the connecting portion, and the adjusting portion under the force of the connecting portion, the range of the adjusting space can be changed, which is more advantageous for the first guiding body of the component adapts and fits the height change of the bottom of the guiding channel.

In the present embodiment, the first member 612 and the second member 613 have adjustment performance. When the force acts on the guiding body or the first member or the second member, the position of the adjustment space between the first member 612 and the second member 613 may be changed. In this embodiment, the first member and the second member may employ an elastic structural member, that can swing in the axial direction of rotation of the lock body. Of course, in other specific embodiments, only the first member 612 or the second member 613 may be provided to have an adjustment property, and when the force acts on the guiding body or the first member or the second member, the adjustment performance is achieved. The deformation of the first member or the second member, may also change the position of the adjustment space between the first member and the second member.

Figure 6:
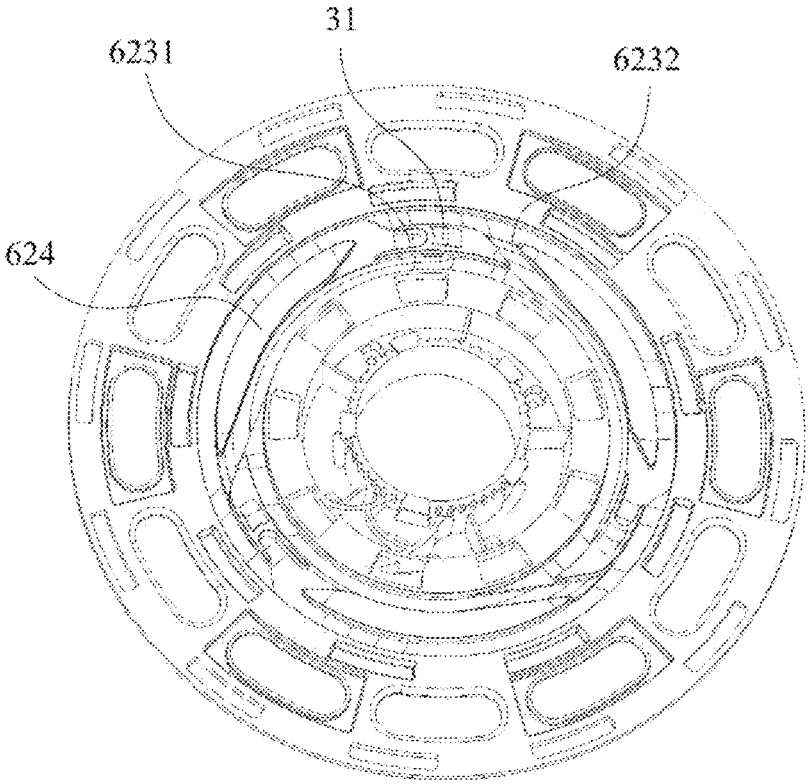

In some embodiments, as shown in FIGS. 4 and 6, a limiting structure 6121 is disposed at a free end of the first member 612, for locking the locking structure against the second structure 3 through the limiting structure 6121, when the first structure 1 and the second structure 3 are relatively locked. A limit condition is formed on the bit member 31. The limiting structure serves as an effective complement to the guiding body, completing the locking between the first structure and the second structure in the locking region. When the guiding body enters the locking region of the guiding channel to complete the locking, the limiting structure also abuts the corresponding limiting member on the second structure to complete the limiting position. Through the double locking of the guiding body and the limiting structure, the reliability of the locking is fully ensured. At the same time, the impact structure of the guide channel groove wall received by the guiding body, when entering the locking position is shared by the limit structure, which reduces the possibility of the guiding body being damaged by impact, and improves the service life and reliability of the lock structure.

Figure 5:
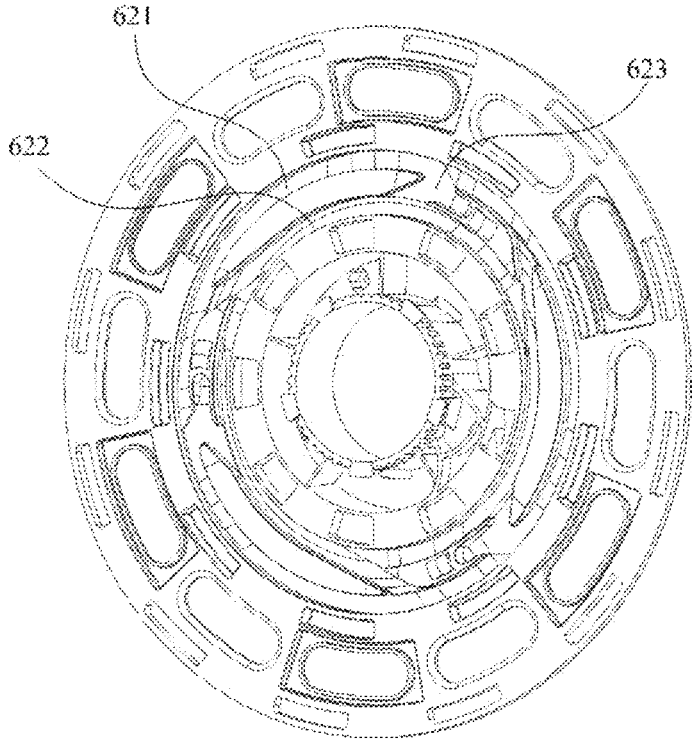
FIGS. 5 and 6 are schematic structural views of a guide channel disclosed in an embodiment of the present invention.

As shown in FIGS. 1 and 5, the embodiment of the invention also discloses a locking device, which is composed of a guiding channel 62 and a locking structure 61, wherein the guiding channel 62 is arranged on the second structure 3. The guiding passage 62 includes a first guiding passage 621 and a second guiding passage 622 and a switching passage 623. Wherein the locking structure 61 can be any one of the specific locking structures 61 described in the above embodiments. The locking structure 61 effects adjustment and/or locking of the first structure 1 and the second structure 3, by movement on the first guiding passage 621 and the second guiding passage 622 and the switching passage 623.

Figure 7:
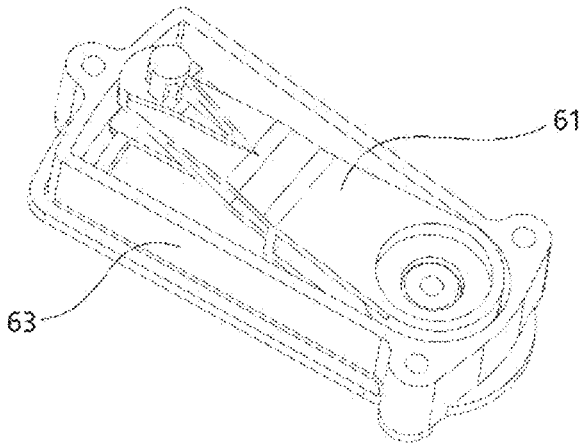
FIG. 7 is a schematic view showing a connection state of a mounting structure and a locking structure according to an embodiment of the present invention.
Figure 8:
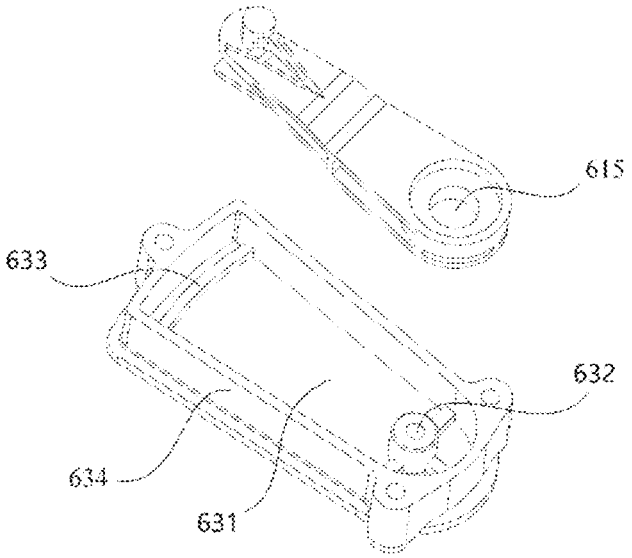
FIG. 8 is a schematic exploded view of a mounting structure and a locking structure according to an embodiment of the present invention.

As shown in FIGS. 7 and 8, in some embodiments, the locking device further includes a mounting structure 63 that is coupled to the first structure 1, and is provided with a mounting cavity 631 for receiving the locking structure 61. Wherein, the rotating shaft 632 is disposed on the mounting structure 63, and extends in a vertical direction from the bottom of the mounting cavity to form a convex structure. Of course, in other specific embodiments, the mounting channel can also be disposed on the mounting structure and disposed in the mounting cavity, and the effects are the same, and the rotatably connected structure of the mounting structure and the first structure can be realized. In this embodiment, the mounting structure may also be a separate structure, which is fixed to the corresponding position inside the first structure by a fastener, and the locking structure can be partially accommodated by the housing structure of the mounting structure, and the locking structure is protected from other parts as little as possible. Destruction of components.

In some embodiments, the mounting cavity 631 includes a first cavity, a second cavity and a third cavity respectively disposed on opposite sides of the first cavity. When the locking structure is relatively rotated by the rotating shaft and the mounting structure, the locking structure is moved from the first cavity to the second cavity, and/or moved from the first cavity into the third cavity, thereby realizing the locking structure performs a switching of the guiding path, and/or a locking of the relative position between the first structure and the second structure, as it moves along the first guide channel and/or the second guide channel and/or the switching channel.

Wherein, the mounting cavity is provided with a first limiting area and a second limiting area, for limiting the radial direction when the locking structure rotates. The first limiting area is located at an end of the first cavity, and the second limiting area is located at an end of the second cavity. The locking structure is moved from the first cavity to the second cavity, when the locking structure is switched from the first guide channel to the second guide channel, and/or the locking structure is switched from the moving state to the locked state in vivo. And the radial direction of the first member and/or the second member is radially limited by the first limiting region. The locking structure is moved from the first cavity to the third cavity, when the locking structure is switched from the second guide channel to the first guiding channel, and/or the locking structure is switched from the moving state to the locked state in the body, and the radial direction of the first member and/or the second member is radially limited by the second limiting region.

By adopting the mounting structure to set the mounting cavity for accommodating the locking structure, the swinging switching of the locking structure in the mounting cavity, can adapt to the switching of the guiding body in the first guiding passage and the second guiding passage. Avoiding the free swing of the guiding body is too large. Resulting in the fact that the second structure, or the first structure is unstable and vibrates and leaves the guiding channel, ensuring that the guiding body can always move stably on the first guide channel, and the second guide channel and the switching channel. Moreover, the mounting cavity also allows the locking structure to be affected, as little as possible by other components during movement along the guiding channel.

In this embodiment, the mounting structure 63 has a side wall 634, that limits the range of rotation of the locking structure 61. The guiding body 614 is movable between the side walls 634 by a maximum distance between the first guide channel 621 and the second guide channel 622. By setting the distance between the side walls of the mounting structure, the swinging amplitude of the locking structure in the mounting structure, just adapts to the switching of the guiding body in the first guiding passage and the second guiding passage, avoiding the free swing of the guiding body is too large. The occurrence of the separation of the guiding passage, due to the unstable vibration of the second structure or the first structure, ensures that the guiding body can always move stably on the first guiding passage, and the second guiding passage and the conversion passage.

In some embodiments, as shown in FIG. 8, a rib 633 for supporting the second member is also disposed within the mounting structure 63. When the locking structure swings within the mounting structure, the front portion of the second member of the second member slides on the rib, to prevent the second member end from directly contacting the bottom of the mounting structure, thereby avoiding excessive front end of the second member. The wearer causes the guiding body to have a large compression stroke, and thus is easily separated from the guiding passage.

In another embodiment, a coiled tubing apparatus is disclosed, including a housing, a reel assembly within the housing, and a tubing assembly disposed on the reel assembly, wherein the tubing assembly is specifically described by the various embodiments described above the locking device is used to open or lock. Specifically, the reel assembly includes a first reel and a second reel, and the first reel is connected with the second reel to form a reel shaft for installation of the pipe assembly, and the pipe assembly is sleeved on the reel of the disc shaft, and rotate synchronously with the reel shaft. Wherein the housing is configured as a first structure and the second reel is configured as a second structure. The guiding passage is disposed on the outer end surface of the second reel, and the locking device realizes the rotation or locking of the pipe assembly with the reel assembly, by adjusting or locking the relative position between the reel assembly and the housing.

Wherein, as shown in FIG. 6, the first guide channel 621 and the second guide channel 622 of the guiding channel and the switching channel 623. The switching passage 623 in the guiding passage may further include a locking portion 6231 and a switching portion 6232. The first guiding passage and the second guiding passage are separated by the middle retaining ring 624, and the locking portion 6231 and the switching portion 6232 are both disposed in the middle retaining ring region. A locking portion, a locking portion inlet, a locking portion outlet and a switching portion are provided in the middle ring region. An inlet guide portion is disposed at a position of the second guiding passage at the lock portion inlet, and a switching guide portion is disposed at a position of the second guiding passage of the switch portion.

When a person needs to use a hose to pull the hose on the reel assembly outward, the hose drives the reel to rotate forward. Since the locking structure 61 is rotatably connected to the housing, and can only swing up and down, the guiding body 614 on the locking structure 61, cooperates with the first guiding passage 621 of the guiding passage 62 and slides along the first guiding passage. When the hose is pulled out to the desired length, the hand is slightly loosened, and the coil spring inside the reel drives the reel to rotate in the opposite direction. When the inlet guide of the first guiding passage 621 is rotated to contact with the guiding body 614, the inlet guiding portion guides the guiding body to swing the guiding body downward, and the guiding body drives the locking structure 61 to swing downward. The guiding body 614 enters the locking portion inlet of the middle retaining ring along the inlet guide portion, and the right reel continues to rotate in the opposite direction, so that the guiding body 614 is caught in the locking portion of the middle retaining ring. At this point, the hose is pulled out to a certain length and locked again, and does not automatically retract, ensuring that the hose can be used without pulling the hose. When people don't use the hose and want to retract it, just pull the hose out a short distance and the hose will drive the reel to continue to rotate forward. The locking portion outlet of the middle retaining ring guides the guiding body 614 of the locking structure 61, so that the guiding body swings downward into the second guiding passage 622. At this time, as long as the hand is released, the coil spring will drive the reel to rotate in the opposite direction, and the reel will drive the hose to retract completely. When the hose is pulled out for a certain length and the guiding body 614 is snapped into the locking portion, and if people want to continue pulling the hose outwards longer, the hose will continue to pull out and the hose will drive the reel to rotate forward. The locking portion outlet of the middle retaining ring, guides the guiding body 614 of the locking structure 61 to swing the guiding body downward into the second guiding passage 622, the person continues to pull the hose outward, and the right reel continues to rotate in the forward direction. When the switching guide of the second guiding passage 622 is in contact with the guiding body 614, the switching guide guides the guiding body 614. The guiding body enters the switching portion 6232 along the switching channel guiding portion, and enters the first guide channel 621 along the switching portion 6232. And people continue to pull the hose out, when the hose is pulled out the required length, loosen the hose, the coil spring will drive the reel to reverse rotation under the action of restoring force. The inlet guide of the first guiding passage 621 is in contact with the guiding body, and the guiding body is again caught in the lock portion 6231 of the intermediate retaining ring. When the guiding body of the locking member moves in the guiding passage, the second member always ensures sufficient pressure of the first member, to ensure that the guiding body can abut the bottom of the guiding passage, thereby smoothly completing the first guiding passage, the second guiding passage and switch between switching channels.

The locking structure of the embodiment precisely, guides the guiding body on the locking member by providing a guiding passage, having a plurality of passages on the side of the reel wall. Through the guiding body control, the reel is locked or rotated in the forward or reverse direction, to ensure smooth operation of the hose on the reel, and the operation is very good for the operator whether it is locking the tube or pulling the tube or shrinking the tube, simple, convenient, and reliable. At the same time, at the movable end of the locking member, the upper and lower structures of the first member and the second member having elasticity are disposed. The first member can press the second member, so that the guiding body of the second member can be closely attached to the bottom surface of the guiding channel, so as to prevent the guiding body from jumping out of the guiding channel when the reel is rotated, and ensuring the guiding body to operate.

Figure 9:
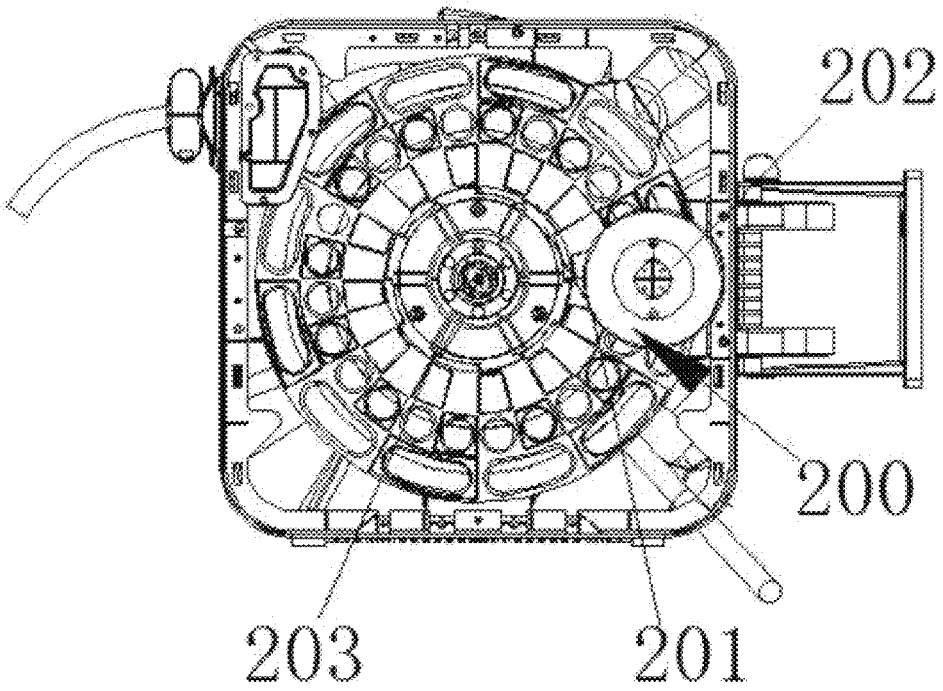
FIG. 9 is a schematic structural view 1 of an embodiment of a coiled tubing device with a cover removed according to an embodiment of the present invention.
Figure 10:
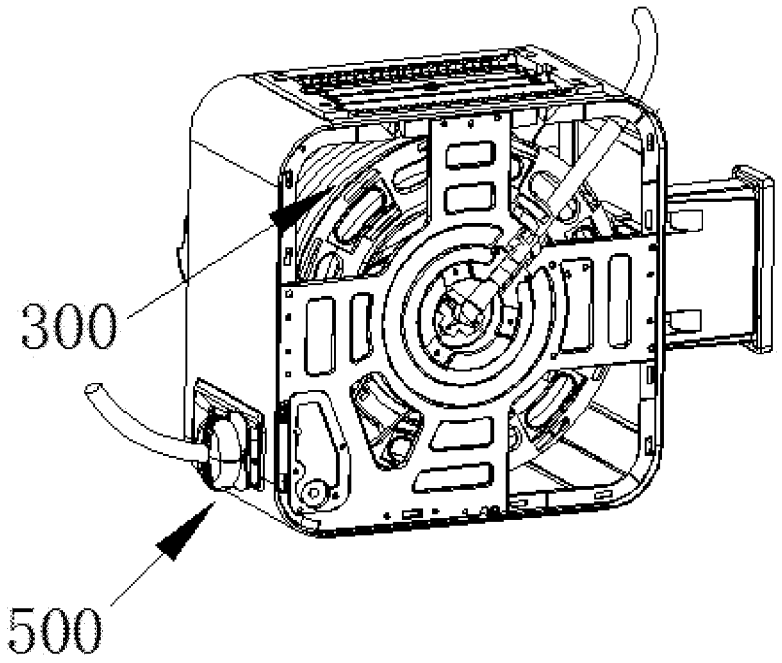
FIG. 10 is a schematic structural view of an embodiment of a rolled tube device with a cover removed according to an embodiment of the present invention.
Figure 11:
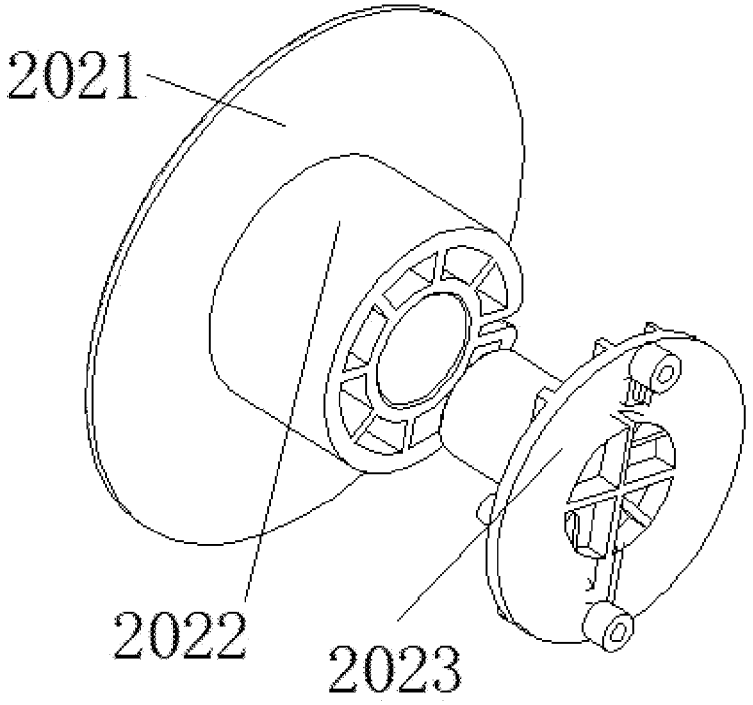
FIG. 11 is a schematic structural diagram of the first support assembly according to an embodiment of the present invention.

As shown in FIG. 9-11, a schematic structural view of each part of an automatic coiling device disclosed in a specific embodiment, including a winding mechanism 300 and an elastic mechanism 200 for powering the tube around the tube. The elastic mechanism 200 has one end connected to the first support assembly 202, and the other end connected to the winding mechanism 300. The elastic mechanism 200 and the winding mechanism 300 of the embodiment, are synchronously rotated about the rotation axis (x), to realize the synchronization of the tube and the tube of the tube by the coiling device. The elastic mechanism 200 includes an elastic member 201, a first support assembly 202 and a second support assembly 203 for supporting the elastic member 201, the elastic member is connected to the first support assembly 202, and the second support assembly 203 in an S-shaped reverse manner. And the elastic member is preferably a constant force coil spring. When the pipe is pulled, the pulling force acting on the pulling pipe member is uniform, and as the pipe member is continuously pulled out, the pulling force is kept uniform, and the pipe fitting is conveniently pulled out. When the pipe is wound around the pipe, the energy is evenly released as the pipe is retracted, so that the pipe is retracted at a uniform speed, and the pipe is easily wound, thereby effectively improving the service life of the coiling equipment. The elastic member 201 is preferably made of a coil spring, which is not easy to rust such as stainless steel, and a coil spring made of stainless steel, which does not need to be annealed at the joint, and is not easily damaged, resulting in a long service life.

In this embodiment, the first support component 202 and the second support component 203 can be integrally formed with the housing structure 100, and the elastic component 201 of the embodiment can be installed. To further enhance the maintenance and disassembly of the coiling device and the ease of assembly, the first support assembly 202 and the second support assembly 203 are preferably detachably coupled to the housing structure 100. As shown in FIG. 11, the first support component 202 of the embodiment is connected to the support member 103. The first support assembly 202 includes a support structure 2021 and a support connecting portion 2023. The first support assembly includes a support structure 2021 connected to the housing structure and a base 1 for winding the elastic member. A support assembly is coupled to the housing structure by a support structure 2021.

Figure 12:
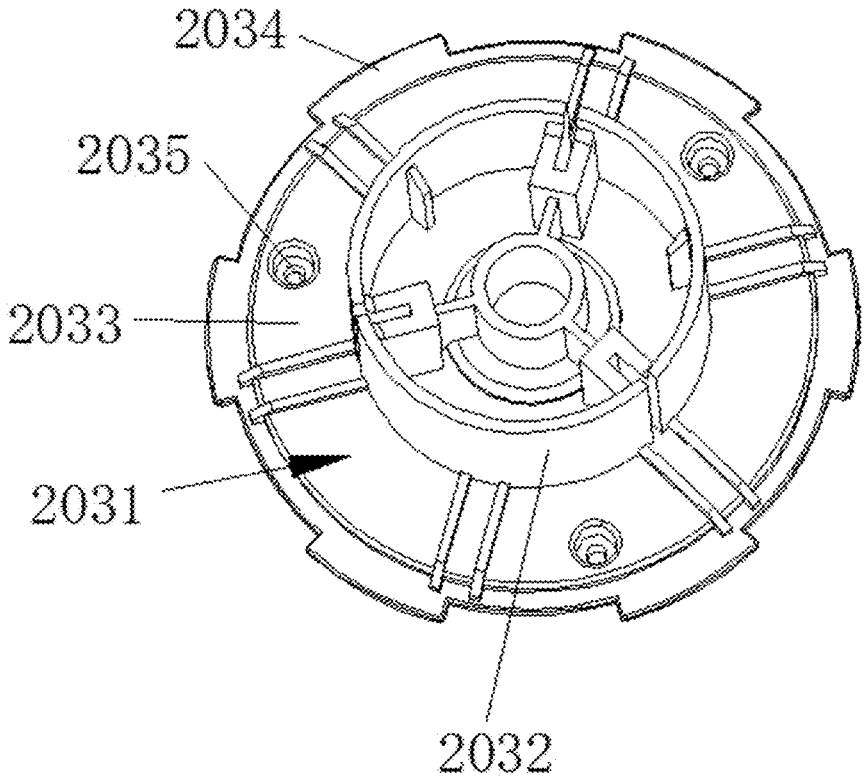
FIG. 12 is a schematic structural view of the second support assembly according to an embodiment of the present invention.

The support structure 2021 and the support connecting portion 2023 may be provided in an integrated structure. It can also be a split structure. The embodiment preferably has a split structure. As shown in FIG. 11, the support structure 2021 is provided with a base one 2022 for winding the elastic member 201. The base one 2022 has a hollow structure in the middle, and one end of the supporting connecting portion 2023 is nested, to realize the connection with the supporting structure 2021, and the other end is connected to the supporting member 103 by a fastener or the like, and the first supporting member 202 is connected. It is firmly connected to the support member 103. As shown in FIG. 12, the second support assembly 203 of the present embodiment includes a support structure 22031, and the support structure 2203 is provided with a base 22032 for winding the elastic member 201, and the second support assembly is supported by Structure 2 is connected to the winding mechanism. The elastic member 201 is connected in an S-shaped reverse manner on the base one 2022 and the base two 2032, one end of the elastic member 201 is connected to the base one 2022, and the other end is connected to the base two 2032. In this embodiment, the elastic member 201 is rotatably connected to the base one 2022 and the base 2 2032 in an S-shape, and is wound around the base 1 and when rotated synchronously with the winding mechanism about the rotating shaft (x), or the base two. When the tube is pulled, the pulling force acting on the pulling tube is uniform, and the pulling force is kept uniform as the tube is continuously pulled out, and the tube member is conveniently pulled out, and the tube is rotated when the tube member is pulled, and the elastic member 201 and the winding tube surround the rotation axis (x) synchronously rotating, so that the elastic member 201 is inverted from the base one 2022 to the base two 2032, and stores energy, which provides power for the tube to be wound around the tube. When the pipe is wound, as the pipe retracts, the pipe rotates around the pipe when the pipe is wound, and the elastic member 201 rotates synchronously with the winding disk about the rotation axis (x). The elastic member 201 is inverted from the base 2032 to the base 2022, and the energy is evenly released, so that the speed of the pipe retracting is uniform, and the pipe is conveniently wound, thereby effectively improving the service life of the coiling device.

Figure 13:
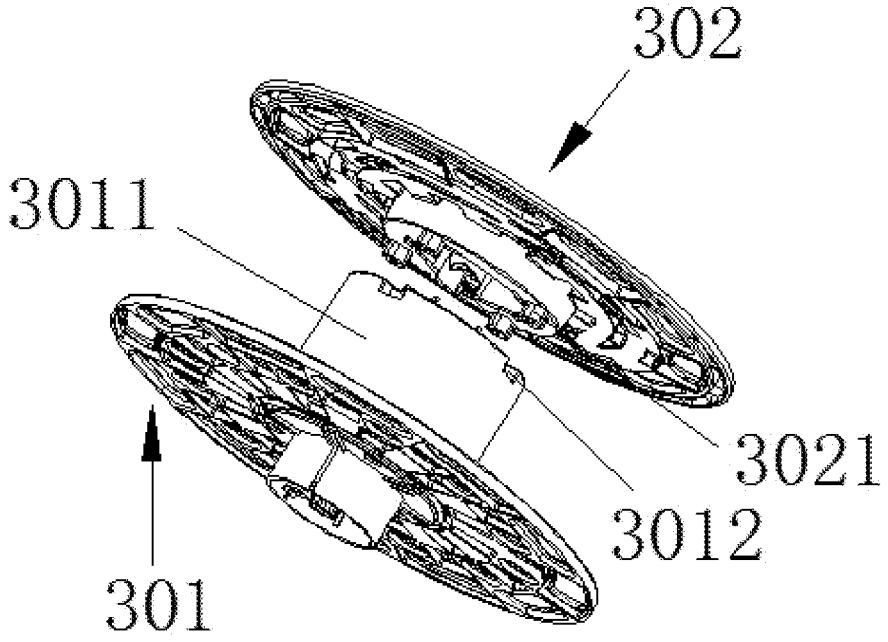
FIG. 13-15 are schematic structural views of the coiled disk of a coiled tubing device according to an embodiment of the present invention.
Figure 14:
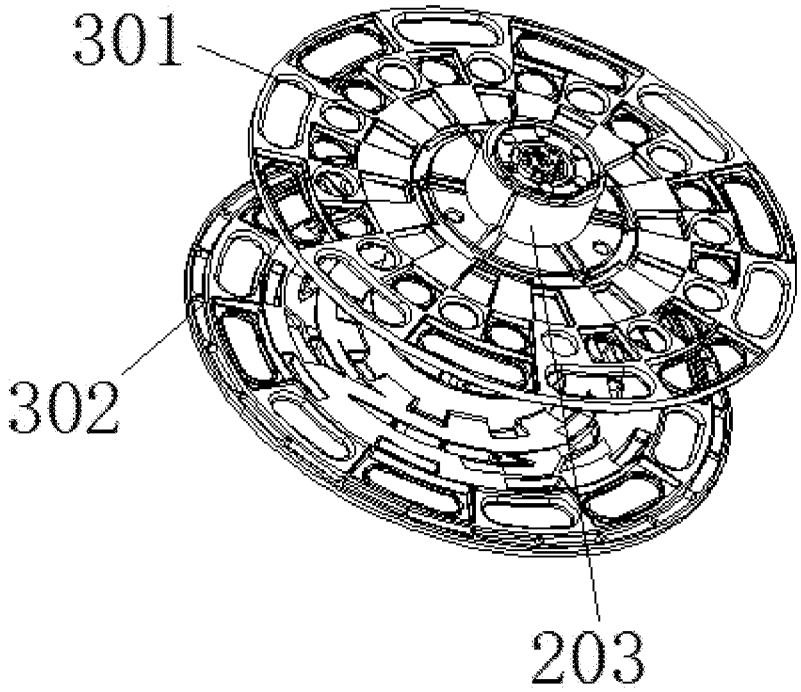
Figure 15:
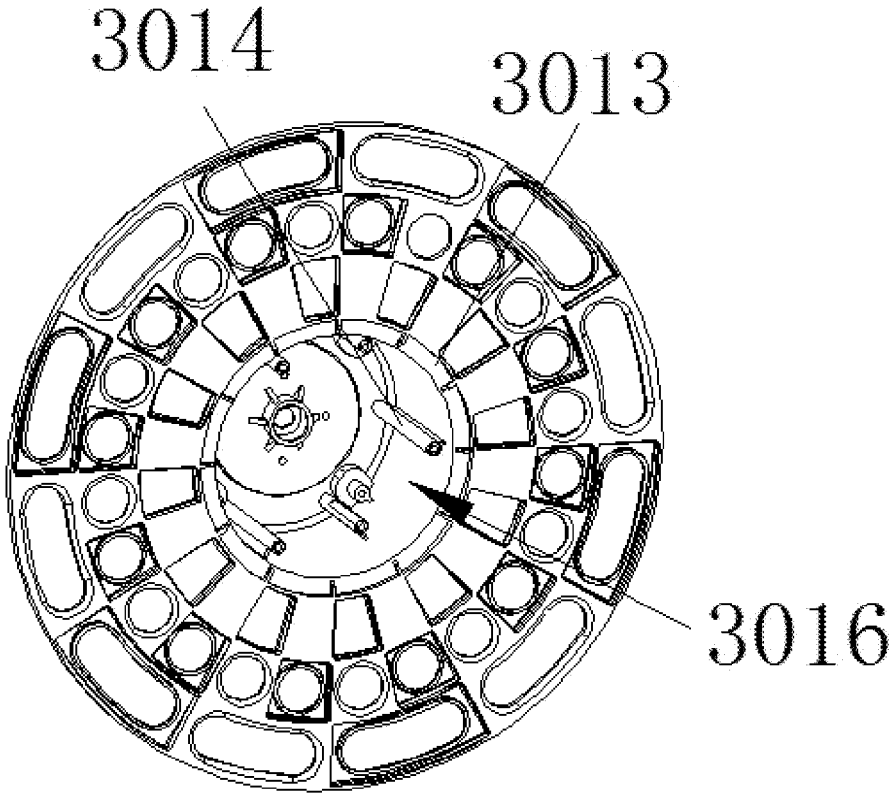

In this embodiment, the winding mechanism 300 includes the above-mentioned winding tube for winding the tube, and the winding tube may be a whole structure or a separate structure. The spool of the present embodiment is preferably a split structure, that is, the detachable connection between the spool body 301 and the cover 302. The utility model comprises a winding disc body 301 for winding a pipe and a cover plate 302 which is coupled with the winding pipe body 301. As shown in FIG. 13-15, the winding tray body 301 is provided with a base three 3011, and the tubular member can be wound on the base three by rotating the winding tray body 301. The bottom of the cover plate 302 of the embodiment is provided with a plurality of buckles 3021, and the corresponding bases 3011 are provided with a corresponding number of card cavities 3012 of the buckles 3021. In use, the tube is rolled into a desired coil by a coiling device, and the rolled tube is placed on the base 3011 of the spool body 301. Then, the cover plate 302 is inserted into the card cavity 3012 of the pipe body 301 through the buckle 3021, and then the two are fixed together by fasteners, and the pipe fitting is convenient to install. Similarly, when the pipe fitting is disassembled, the cover plate 302 only needs to be detached relative to the pipe body 301, so that the pipe member can be removed, the operation is convenient, and the disassembled pipe member is wound into a roll, and is not occupied and tidy when placed.

In this embodiment, as shown in FIG. 12, the second support component 203 may be integrated with the spool body 301, or may be a split structure. The second support component 203 of the embodiment, is detachably connected to the spool body 301, the support structure 2203 of the embodiment includes a support mounting portion 2033 and at least one buckle two 2034. The buckle two 2034 is formed to extend outward along an edge of the support mounting portion 2033, and the support mounting portion 2033 is provided with multiple Mounting hole 2035 for connection. The reel body 301 is provided with a locking groove 3013, corresponding to the number of the buckles 2034 and fitted with the buckles 2034, and is further provided with a corresponding number of the mounting holes 2035, and a mounting post 3014 connected to the mounting hole 2035, the buckle 2304 of the second supporting component 203 is inserted into the locking groove 3013, and is fixedly connected by the fastener penetrating into the mounting hole 2035 and the mounting post 3014, and the second supporting component 203 is opposite to the winding tray. The body 301 is configured as a detachable connection to facilitate maintenance, and assembly of the coiled tubing equipment.

Figure 16:
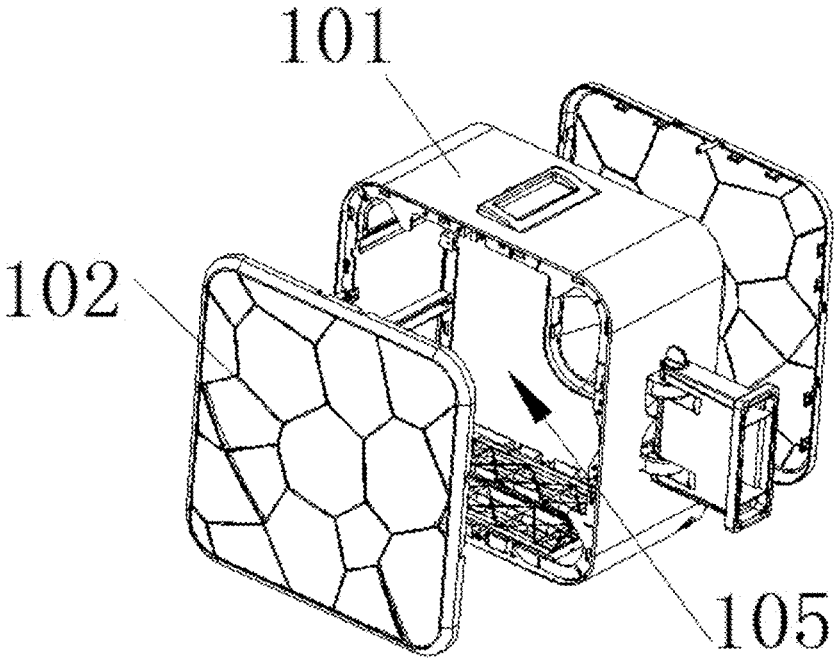
FIG. 16 is a schematic structural view of the housing structure according to an embodiment of the present invention.
Figure 17:
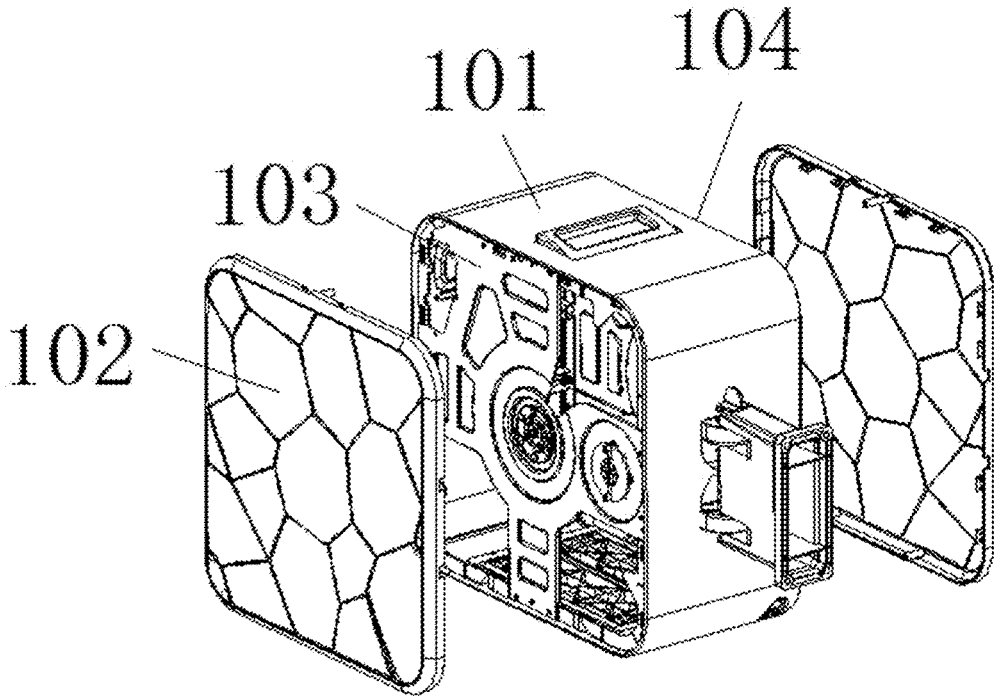
FIG. 17 is a schematic structural view of the housing structure for a coiled tube device according to an embodiment of the present invention.

As shown in FIGS. 16 and 17, as a embodiment of the present invention, a housing structure of a coiling device of the present invention includes a housing 101 and a cover assembly 102, wherein the housing 101 has a square structure or at least a square structure such as a rectangle, or a square structure. The housing 101 of the present embodiment has two surfaces (M, M') 1015 disposed as openings, and the cover assembly 102 is located at the surface (M, M') 1015 of the opening, and is used to close the surface (M, M') 1015, the housing 101 and the cover assembly 102 are combined to provide rigidity to the coiled tubing apparatus, i.e., provide support, and the housing 101 and the cover assembly 102 enclose a placement space 105. For accommodating the coiling mechanism 300 and the elastic mechanism 200, as well as the tubular members and their attachments, the placement space is substantially enclosed.

Figure 18:
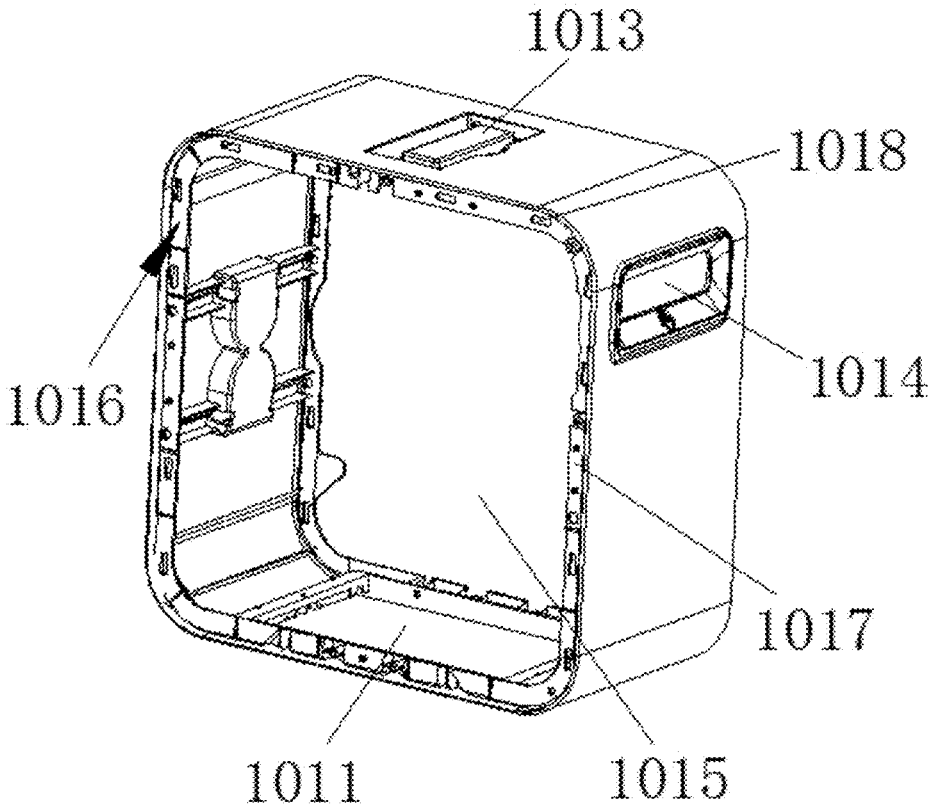
FIG. 18 is a schematic structural view 1 of the housing according to an embodiment of the present invention.
Figure 19:
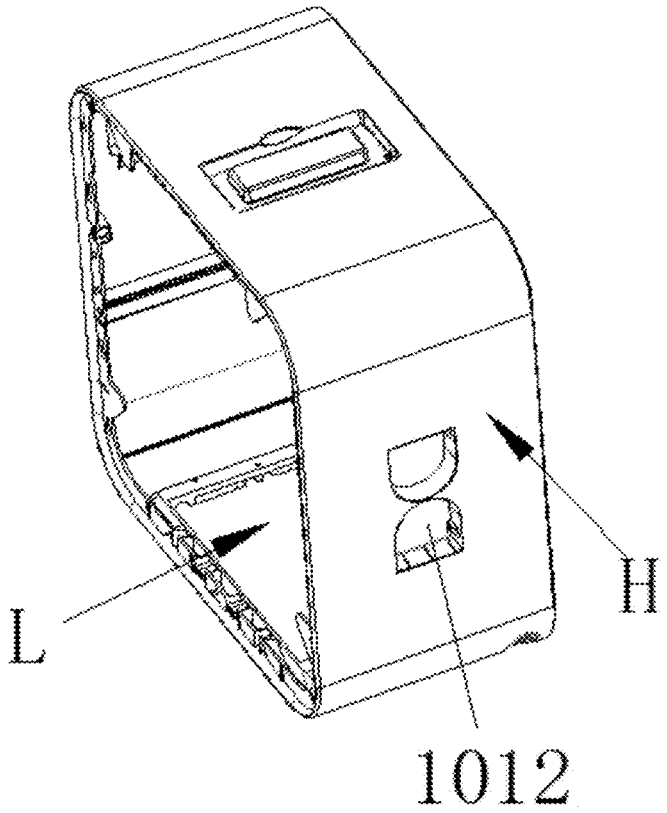
FIG. 19 is a second schematic structural view of a housing according to an embodiment of the present invention.

In the present embodiment, as shown in FIG. 18 or 19, the casing 101 is an integrally formed structure, which can be formed by injection molding, and the structure which can be formed by injection molding is basically manufactured by a mold, and can be mass-produced, and good stability, while improving production efficiency, it can also ensure the uniformity of product batch. The square-shaped housing 101 has a circular chamfer and a smooth transition on the adjacent faces, that is, the four corners of the housing 101, which are not only beautiful in appearance, but also have good placement stability, and the base to be placed is preferably a horizontal plane, or at least it is a basic horizontal plane, and of course the placement stability in a non-horizontal plane is much better than that of a non-square structure.

Figure 25:
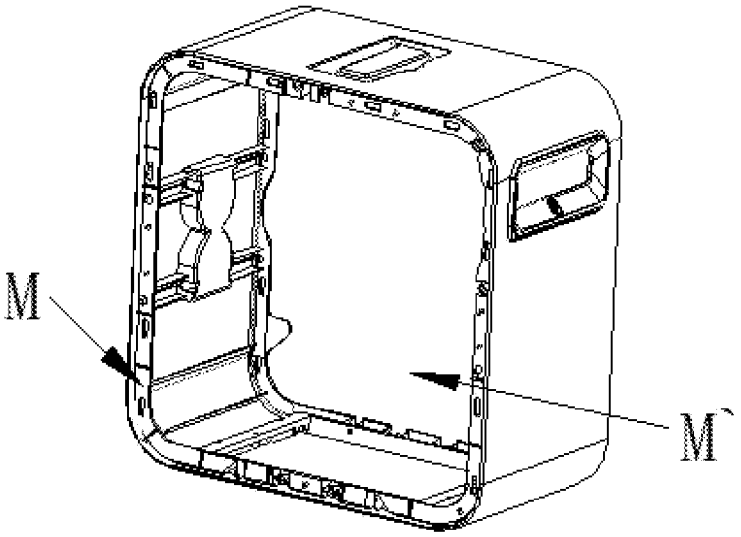
FIG. 25 is a schematic structural view 1 of the housing according to an embodiment of the present invention.

In the present embodiment, as shown in FIG. 18, the opening direction and the rotation axis (x) of the surface (M, M') 1015 of the opening of the casing 101 may be arranged in parallel or vertically. In the present embodiment, a parallel arrangement is taken as an example, that is, two surfaces (M, M') 1015 of the opening as shown in FIG. 25 are disposed, in parallel with the rotation axis (x) as shown in FIG. 7.

Figure 20:
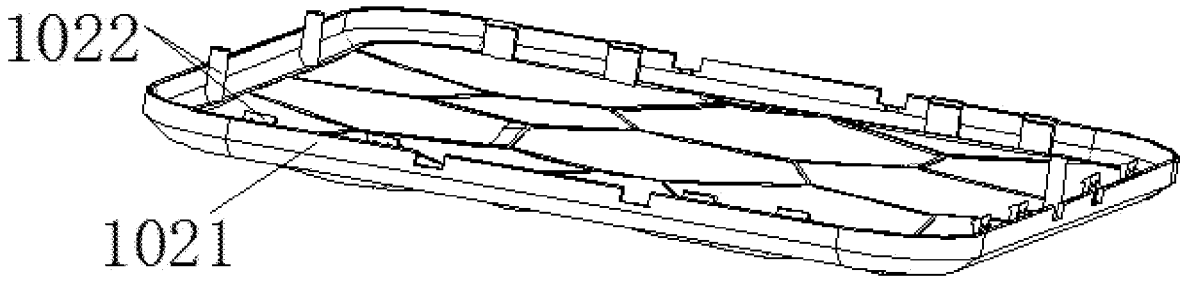
FIG. 20 is a schematic structural view of a cover assembly according to an embodiment of the present invention.

In this embodiment, the housing 101 and the cover assembly 102 are detachably connected. As shown in FIG. 18-20, the cover assembly 102 of the present embodiment is provided with an edge member 1021, which is disposed on the corresponding housing 101. There is a closed space 1016 for the edge member 1021 to be engaged. The housing of the present embodiment is provided with a flange member 1017 inwardly along the surface of the opening, the closed space being formed by the surface of the housing to the area between the flange members 1017, and the cover assembly 102 is inserted by the edge member 1021. In the closed space 1016 on the housing, it is ensured that the cover assembly 102 completely closes the open surface (M, M') 1015 of the housing 101. In order to ensure a more stable connection between the housing 101 and the cover assembly 102, a housing snap member may be disposed on the housing, and the cover assembly is provided with a card slot assembly for engaging the housing snap member; And/or the cover assembly 102 is provided with a cover snap member 1022, the housing is provided with a card slot assembly member 1018 for the cover snap member 1022 to be engaged. The cover capping member 1022 of the embodiment is not limited to one, and should be multiple, the specific structure of the cover snap member 1022 is set as needed, and is not limited to the structure in the view of the embodiment. The corresponding card slot assembly 1018 is not limited to one, and should be plural, and is disposed in cooperation with the cover snap member 1022. The housing snap member and the card slot assembly 1018 of the present embodiment are disposed on the flange member 1017. The cover clip fastening member 1022 and the card slot assembly are disposed on the edge member 1021, and are all integral structures.

As shown in FIG. 17, since the surface (M, M') of the casing 101 is open, in order to increase the supporting strength of the casing 101, a support member 103 and a support member 104 for supporting functions are further provided, further Improve the stability of the tube winding machine. The housing structure 100 of the present embodiment further includes a support member 103 and a support member 104, disposed on the surface of the opening and disposed in parallel with the surface (M, M'), and the support member 103 and the support member 104 are respectively The housing 101 is connected. The support member 103 and the support member 104 of the present embodiment may be a plate-like structure, or may be a combined structure capable of improving the support strength, regardless of the specific structure, as long as the similar structure for strengthening is applicable. In this embodiment, the material may be a metal material, or may be a plastic material having a certain hardness or other material having a certain hardness. In the structure, the support member 103 and the support member 104 are located in the cover assembly 102 and are the cover assembly 102 is closed.

In this embodiment, the housing structure not only functions as a support, but also is associated with other functional structures of the coiled tubing device. The guide hole 1014 for guiding the tubular member on the coiled tubing apparatus of the present embodiment is disposed on the housing, and one can be disposed, or multiple.

Further, the support structure for supporting the coiled tubing device is also disposed on the housing, and in order to make the coiled tubing device simple in structure and beautiful in appearance, the housing 101 is provided with a storage space for accommodating the support structure, which is convenient for transportation or carrying. And does not take up space.

Further, for the convenience of carrying, the handlebar device is also provided with a handle. When the transport or the winder is not in use, the handle is usually stored to reduce the space occupied, so that the handle is provided on the casing for storing the handle. The handle is placed in the cavity 1013 for the storage of the handle.

As shown in FIGS. 21-25, as an embodiment of the present invention, a coiling apparatus includes a winding mechanism 300, an elastic mechanism 200, and the above-described housing for supporting the winding mechanism 300 and the elastic mechanism 200. The body structure 100, the housing structure 100 not only functions to support the winding mechanism 300, the elastic mechanism 200, the pipe members, and the attachments thereof, but also protects the structure from dust, obstacles or particles.

In the present embodiment, as shown in FIG. 15, a slow retracting mechanism 400 for controlling the retracting speed of the tube member is provided, and the reeling mechanism 400 is provided on the winding disc main body 301 along the axis (x) direction. The mounted cavity one 3016, the slow retracting mechanism 400 and the reel body 301 rotate synchronously about the axis of rotation (x).

In the present embodiment, as shown in FIG. 10, when the tube is drawn and the tube is shrunk, it is also guided by a tube guide 500 provided on the tube device, which is used to guide the tube to the winding. The tube member 301 guides the tube member from or around the tube body 301. The tube guiding device 500 is positioned at least partially or completely inside the placement space, a portion of the tube guiding device 500 of the present embodiment is completely located in the placement space, a portion is located outside the prevention space, and the tube guiding device 500 defines that the tube member can pass A guide hole 1014 is guided, and the guide hole 1014 of the present embodiment is disposed on the casing 101.

Figure 26:
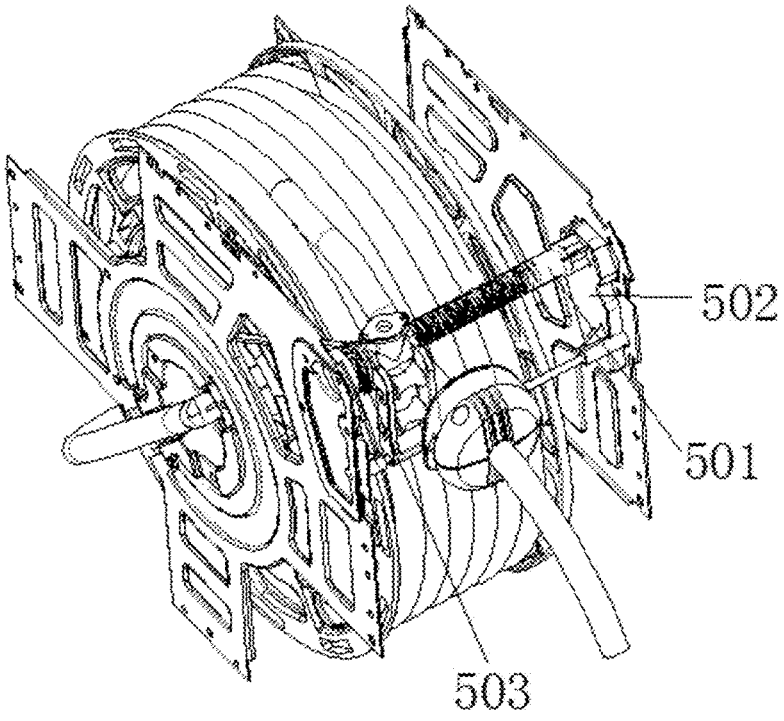
FIG. 26 is a schematic structural view of the pipe guide device according to an embodiment of the present invention.
Figure 27:
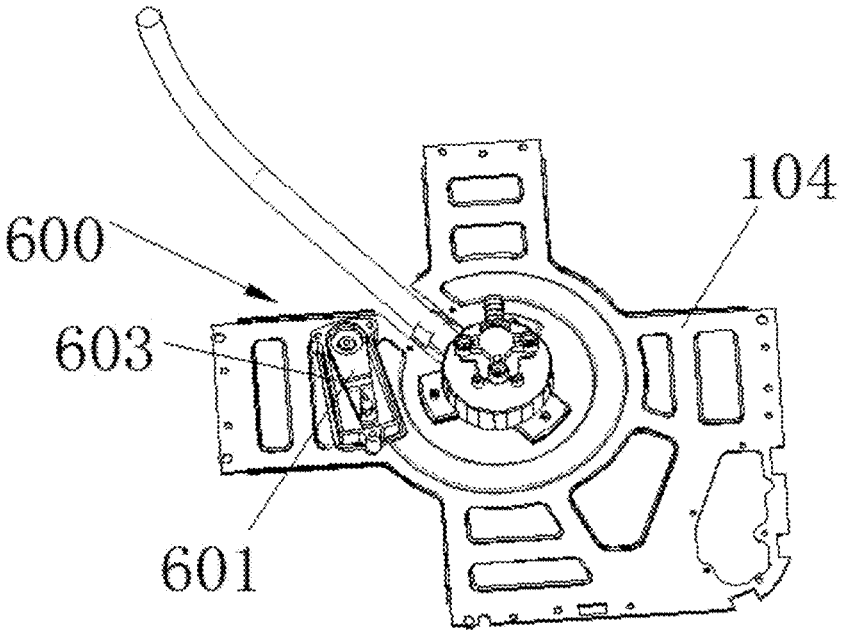
FIG. 27 is a schematic structural view of a cover plate of the present invention according to an embodiment of the present invention.

In the present embodiment, as shown in FIG. 26, the pipe guide 500 includes a guide roller 501 for guiding the pipe member, a guide roller support frame 502 supporting the guide roller 501, and a guide transmission 503, the guide roller support frame the two ends of the 502 are respectively connected with the support member 103 and the support member 104 to serve as a support. The guiding transmission device 503 is connected to the guiding roller 501 and the winding tube body 301, and rotates around the tube body 301 by the pulling tube and the retracting tube member, to realize the driving of the guiding transmission device 503 around the tube body 301. Linkage to achieve the synchronization of pipe guide and shrinkage.

Figure 21:
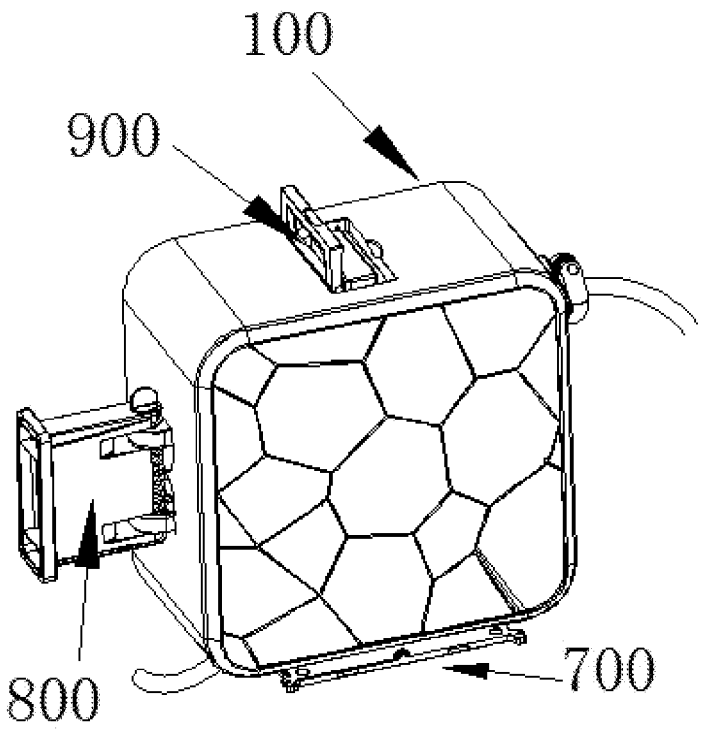
FIG. 21 is a first structural schematic view showing an embodiment of the roll-up device handle and the support structure according to an embodiment of the present invention.
Figure 22:
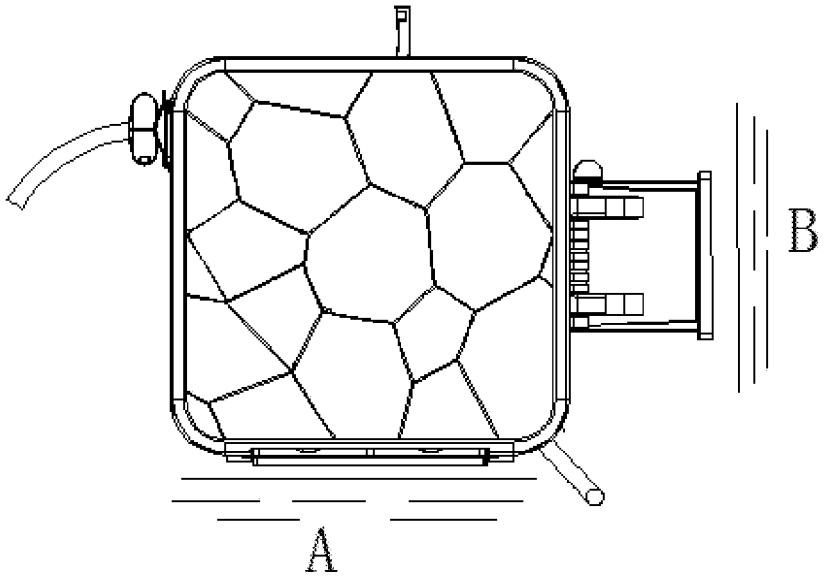
FIG. 22 is a front elevational view showing an embodiment of the roll-up device handle and the support structure according to an embodiment of the present invention.
Figure 23:
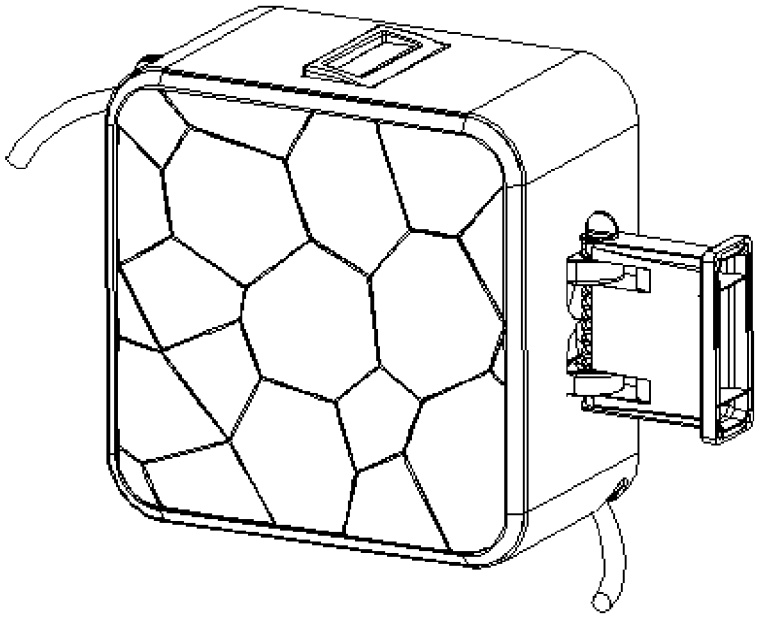
FIG. 23 is a schematic structural view 1 of an embodiment of a coiled tube device handle and the support structure closed according to an embodiment of the present invention.
Figure 24:
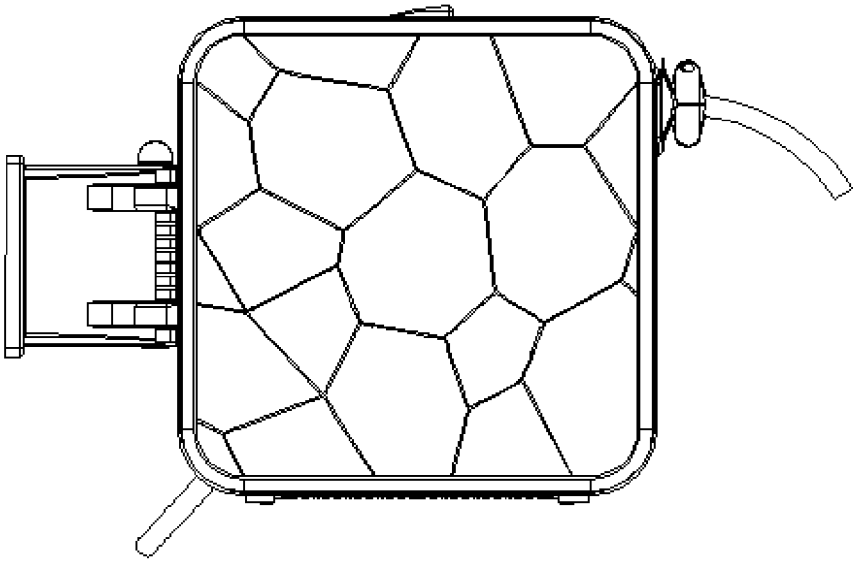
FIG. 24 is a front elevational view showing an embodiment of the roll-up device with a handle and a support structure closed according to an embodiment of the present invention.

As shown in FIGS. 21 and 22, as an embodiment of the present invention, a coiling apparatus includes a housing structure 100, and further includes a first support assembly and/or a second support assembly 800 for supporting the coiled tubing apparatus, a support assembly and/or a second support assembly 800 can be selected for installation, and both can also serve as a support. In this embodiment, the description is made by both of them, and the actual user can also select one of them to be installed for supporting the coiling device. The first supporting component of the embodiment is disposed at the bottom of the housing structure 100 for, the vertical support, the second support assembly 800 is disposed on the side of the housing structure 100 for side support, and both the first support assembly and the second support assembly 800 are coupled to the housing structure 100.

Figure 28:
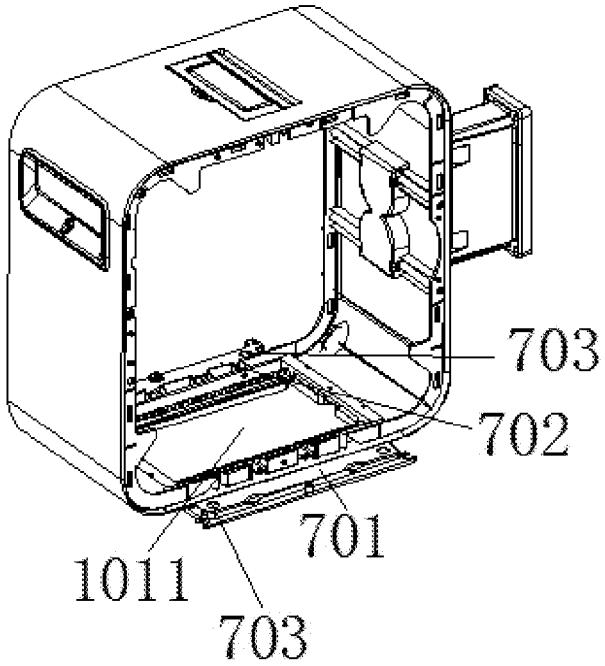
FIG. 28 is a schematic structural view 1 of the first support assembly according to an embodiment of the present invention.
Figure 29:
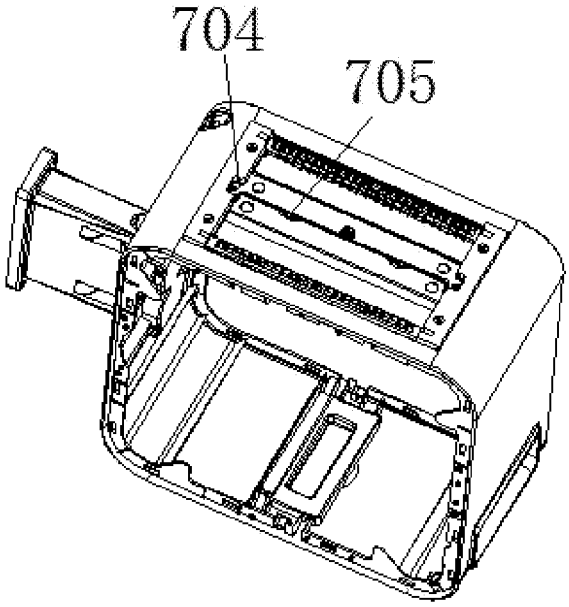
FIG. 29 is a schematic structural view of the first support assembly according to an embodiment of the present invention.
Figure 30:
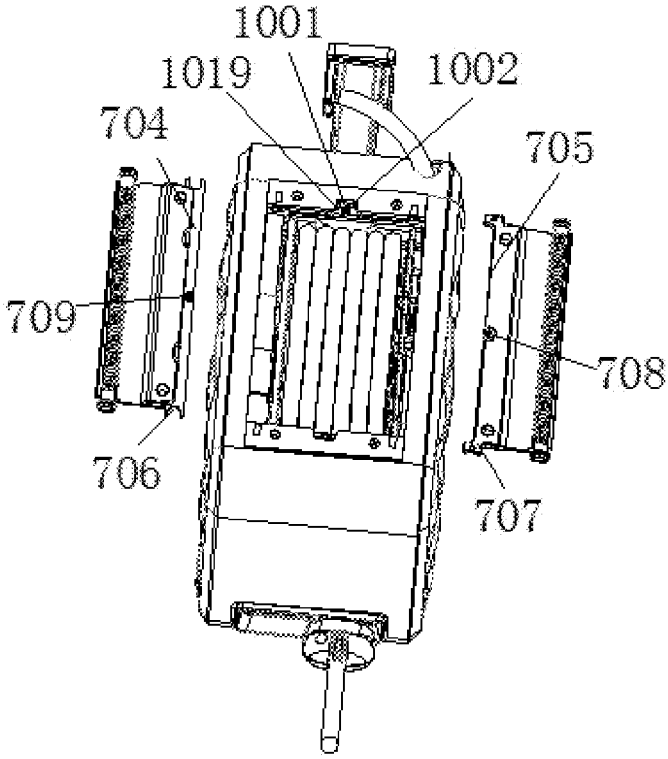
FIG. 30 is a second schematic structural view of the first support assembly according to an embodiment of the present invention.

In this embodiment, as shown in FIGS. 28-30, the first support assembly is movably connected to the housing structure 100. As an embodiment of the present invention, the connection manner such as the sliding connection is also applicable to the connection of the embodiment. When slidingly connected, a slide rail is disposed at a bottom of the housing structure 100, and the first support assembly slides relative to the housing structure 100 to realize opening and/or storage, and facilitates transportation of the coiled tubing device during storage. As another embodiment of the present invention, the present embodiment is preferably a rotational connection, which is opened and/or received by the rotational connection with respect to the housing structure 100. Therefore, the first support after storage is made, so that the overall structure of the coiled tubing device is simple and compact. The assembly is placed in a receiving space 1011 at the bottom of the housing structure 100.

In this embodiment, as shown in FIG. 22, the first supporting assembly is used to mount the coiling device on the planar base (A), and the planar base (A) of the embodiment may be a supporting plane such as the ground. When the tube device is placed on the planar base (A), the first support assembly defines the alignment of the coiled tubing device with respect to the planar base (A) for improving the stability of the tubular member when it is pulled or retracted. In the present embodiment, the alignment of the coiling device defined by the first support assembly, is such that the axis of rotation (x) of the coiled disk is parallel with respect to the planar base (A), which is preferably horizontal plane, or at least a substantially horizontal plane, such that the axes of rotation are parallel or at least substantially parallel.

In the present embodiment, as shown in FIG. 29, the first support assembly includes a support member 1 disposed against the planar base portion (A), the support member 1 including a support portion one 701 and a support portion two 702, the support portion one 701 and the support portion two 702 are rotatably connected to the bottom of the housing. The support portion one 701 and/or the support portion two 702 are provided with a fixing hole one 703 for connection with the planar base portion (A). When the support portion one 701 and the support portion two 702 are opened, the width is larger than the housing. Width, through a fixing hole one 703 through a fixing hole one 703 to abut or fix the coiling device on the plane base (A). When the support member is received, its width dimension is located within the width of the housing, so that the overall structure of the coiled tubing device is compact. During the storage, the support portion one 701 and the support portion two 702 are coupled to each other. The support portion one 701 is provided with a latching portion 704 at a position connecting the support portion two 702, and corresponding to the support portion two 702. In the engaging portion two 705, the supporting portion 701 and the supporting portion 702 are engaged with each other by the engaging portion two 705 against the engaging portion one 704. The two ends of the engaging portion one 704 are connected to the housing structure 100 through the locking portion one 706. Similarly, the two ends of the engaging portion two 705 are coupled with the locking portion one 706 through the locking portion 707, and the buckle portion 706 and the snap portion two 707 are embedded in the snap groove 1019 of the housing structure 100. The connecting portion 707 is provided with a connecting hole three 1002*ting* hole one 708, and the connecting portion 706 is provided with a connecting hole 709 which is coupled with the connecting hole one 708. The support portion one 701 and the support portion two 702 are also connected by a fastener through the connection hole 708 and the connection hole 709. The connecting slot 10019 is further provided with a connecting post 1001. The connecting post 1001 is provided with a connecting hole three 1002 that is coupled with the connecting hole one 708. The connecting hole one 708 and the connecting hole three 1002 are passed through the fastener. The support portion one 701 and the support portion two 702 are connected to the housing structure 100, which greatly improves the stability of the support member after being stored, is not easy to lose, and is convenient for transportation.

Figure 31:
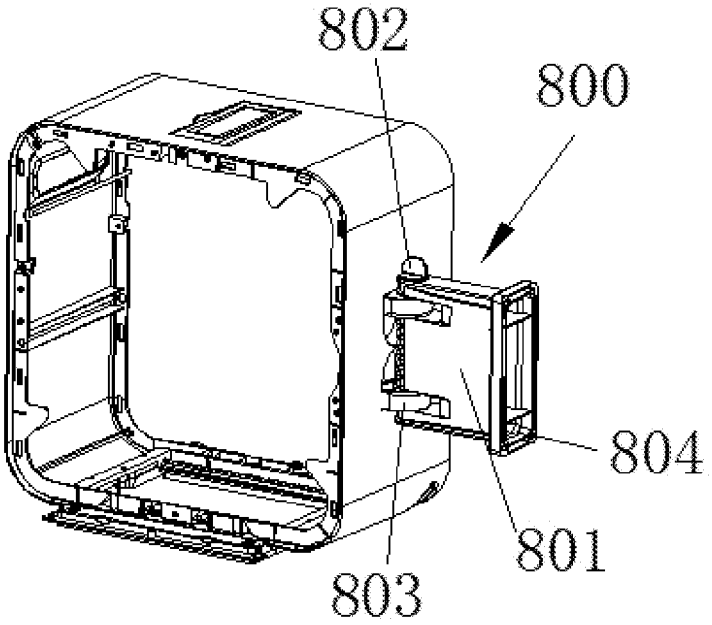
FIG. 31 is a schematic structural view of the second support assembly according to an embodiment of the present invention when it is opened.

In this embodiment, as shown in FIG. 31, the second support assembly 800 is used to mount the coiling device on the planar base (B). The planar base (B) of the embodiment may be a support plane such as a wall. When the coiling device is disposed on the planar base (B), the second support assembly 800 defines the alignment of the coiled tubing device with respect to the planar base (B) for improving stability of the tubular during withdrawal or retraction. In the present embodiment, the alignment of the coiling device defined by the second support assembly 800 is such that the axis of rotation (x) of the spool is perpendicular to the planar base (B), the planar base (B) is preferably a horizontal plane, or at least a substantially horizontal plane, such that the axis of rotation is vertical or at least substantially vertical.

In the present embodiment, as shown in FIG. 31, the second support assembly 800 includes a support member two 801 disposed against the planar base portion (B), a support shaft two 802 coupled to the support member two 801, and a support member. The second connecting member two 803 is connected to the housing structure 100, and the supporting connecting member two 803 is movably connected with respect to the housing structure 100. As an embodiment of the present invention, the connection manner such as the sliding connection is also applicable to the connection of the embodiment. When the sliding connection is provided, a slide rail is disposed at the bottom of the housing structure 100, and the support connector two 803 slides relative to the housing structure 100. To achieve opening and/or storage. As another embodiment of the present invention, the present embodiment is preferably a rotary connection, which is opened and/or accommodated with respect to the housing structure 100 by a rotational connection, and facilitates transportation of the coiled tubing device during storage, so that the overall structure of the coiled tubing device is simple and compact, so that the received support connector two 803 is placed in the storage space two 1012 at the bottom of the housing structure 100.

When supporting, that is, the second support assembly 800 is in an open state, the support member two 801 is coupled to the housing 101 through the support shaft 802, and the coiled device is passed through the fixing hole 804 by a fastener having a certain strength. Rely on or fixed to the base of the plane (B), the second support assembly 800 thus defines the alignment of the coiling device with respect to the planar base (B), such that the axis of rotation (x) about the tube disk is perpendicular to the planar base (B). When moving or accommodating the reel device, the reel device is usually in a state of no abutment or loosening relative to the planar base (B), and the second support assembly 800 is detachable relative to the housing 101, that is, the support member two 801 and the support shaft two 802 disassembly. The support connector two 803 is rotated 90 degrees with respect to the side portion (H) of the housing 101, and the support connector two 803 is located in the housing space two 1012 on the side portion (H) of the housing 101 as shown in FIG. 13, and the supported support is received. The connector member 803 is in a substantially or fully closed state. Typically, the second bearing assembly support shaft two 802 800 is placed sideways from the direction in which the coiled tubing device is placed when supported.

As shown in FIG. 21, in order to further improve the practicability of the coiling device of the present embodiment, it is convenient to carry. Therefore, the handlebar 900 is also provided on the coiling device, and the handle 900 is rotatably connected with the casing 101, and the handle is not in use, the handle 900 is placed in the placement cavity three 1013 on the housing 101, substantially at the same level as the surface of the housing, facilitating the transportation of the coiling device; when the handle 900 is used, the handle 900 is rotated by a certain angle. It is generally 90 degrees and is used to pick up the coiling equipment for easy lifting.

The coiling device of the present invention is mainly described by taking a pipe such as a hose for sprinkling, and similarly, a coil such as an optical cable or a wire is also applicable to the coiling device of the present invention.

It should be noted that the above embodiments are only used to illustrate the technical solutions of the present invention, and are not limited thereto; although the present invention has been described in detail with reference to the foregoing embodiments, those skilled in the art should understand, that the technical solutions described in the foregoing embodiments are modified, or some of the technical features are equivalently replaced; and the modifications or substitutions do not deviate from the scope of the technical solutions of the embodiments of the present invention.

In summary, the above description is only the preferred embodiment of the present invention, and all changes and modifications made by the scope of the present invention should be covered by the present invention.

What is claimed is:

1. A locking structure, for adjusting or locking a relative position between a first structure and a second structure, comprising:

a locking body configured to be movably connected to the first structure;

a first member, configured to extend along the length of the locking body and connected to the locking body; and a guiding body, disposed on the first member;

wherein the guiding body is configured to adjust the relative position between the first structure and the second structure by moving along a guiding channel, the guiding body is configured to lock a relative position between the first structure and the second structure by entering a locking area of the guiding channel; and wherein the locking body is provided with a mounting channel for mounting a rotating shaft disposed on the first structure, wherein the locking body is rotatable relative to the rotating shaft to achieve a rotational connection with the first structure.

2. The locking structure according to claim 1, wherein the first structure is provided with a mounting channel for mounting a rotating shaft disposed on the locking body, wherein the locking body is rotatable relative to the rotating shaft to achieve a rotational connection with the first structure.

3. The locking structure according to claim 2, wherein one end of the guiding body is connected to the first member, and the other end of the guiding body is provided as a free end, wherein the free end of the guiding body is configured for guiding along the guiding channel during movement.

4. The locking structure according to claim 3, wherein the guiding body is provided with a protruding structure formed from an end surface perpendicular to the first member, and the protruding structure is formed from an extension from an end surface of the first member.

5. The locking structure according to claim 4, wherein the guiding body and the first member are additionally connected by a first connecting member, wherein the first connecting member extends from the end surface of the first member to the outer end surface of the guiding body, and is limited by the outer end surface of the guiding body, wherein the width of the first connecting member is gradually increased.

6. The locking structure according to claim 1, wherein the locking structure further includes a second member, the second member is formed to extend along the longitudinal direction of the locking body, and the second member is connected to the locking body; wherein an adjusting space is provided between the second member and the first member, and wherein the adjustment space is for position adjustment of the first member and/or the second member.

7. The locking structure according to claim 6, wherein the first member and the second member are disposed non-parallel with respect to the locking body, and the first member and the second member are respectively disposed obliquely to both sides of the rotating surface of the locking body.

8. The locking structure according to claim 7, wherein the second member comprises a connecting portion and an adjusting portion, the connecting portion is formed by extending from the locking body, one end of the adjusting portion is connected to the connecting portion, and the adjusting portion is disposed at an angle to the connecting portion in a direction away from the first member.

9. The locking structure according to claim 8, wherein the first member and/or the second member have an adjustment capability, and when a force acts on the guiding body and/or the first member and/or the second member, the position of the adjustment space between the first member and the second member is changed.

10. A locking device, comprising:

the guiding channel, disposed on the second structure, wherein the guiding channel comprises a first guide channel and a second guide channel and a switching channel; and the locking structure according to claim 1, wherein the locking structure adjusts and/or locks the first structure and the second structure, by the locking structure's movement on the first guide channel and the second guide channel and the switching channel.

11. The locking device according to claim 10, wherein the locking device further comprises a mounting structure, the mounting structure being coupled to the first structure and having a mounting cavity for receiving the locking structure.

12. The locking device according to claim 11, wherein the rotating shaft is disposed on the mounting structure, and the rotating shaft is a convex structure extending from the bottom of the mounting cavity in a vertical direction.

13. The locking device according to claim 11, wherein the mounting channel is disposed on the mounting structure, and disposed within the mounting cavity.

14. A hose coiled equipment, comprising: a housing, a reel assembly within the housing, and a tubing assembly disposed on the reel assembly, the tubing assembly is opened and/or locked by the locking device according to claim 10.

15. The hose coiled equipment according to claim 14, wherein the reel assembly comprises a first reel and a second reel, the first reel is connected to the second reel to form a reel shaft for pipe assembly installation, and the tubing assembly is sleeved on the reel shaft and rotates synchronously with the reel shaft.

16. The hose coiled equipment according to claim 15, wherein the housing is configured as the first structure, the second reel is configured as the second structure, and the guiding channel is disposed on the outer end surface of the second reel;

wherein the locking device effects rotation and/or locking of the tubing assembly with the reel assembly by adjusting and/or locking the relative position between the reel assembly and the housing.

* * * * *